US007516589B2

(12) United States Patent
Messiqua et al.

(10) Patent No.: US 7,516,589 B2
(45) Date of Patent: Apr. 14, 2009

(54) HIGH-STRENGTH CONCRETE WALL FORMWORK

(75) Inventors: Pierre Messiqua, Mies (CH); Régis Messiqua, Mies (CH)

(73) Assignee: Polyfinance Coffor Holding S.A., Fribourg (CH)

( * ) Notice: Subject to any disclaimer, the term of this patent is extended or adjusted under 35 U.S.C. 154(b) by 372 days.

(21) Appl. No.: 10/576,696

(22) PCT Filed: Nov. 26, 2003

(86) PCT No.: PCT/IB03/05541

§ 371 (c)(1),
(2), (4) Date: Apr. 21, 2006

(87) PCT Pub. No.: WO2005/042864

PCT Pub. Date: May 12, 2005

(65) Prior Publication Data

US 2007/0028544 A1 Feb. 8, 2007

(30) Foreign Application Priority Data

Nov. 3, 2003 (CH) ..... 1875/03

(51) Int. Cl.

| | |
|---|---|
| ***E04H 12/18*** | (2006.01) |
| ***E04H 12/00*** | (2006.01) |
| ***E04H 1/00*** | (2006.01) |
| ***E04H 3/00*** | (2006.01) |
| ***E04H 5/00*** | (2006.01) |
| ***E04H 6/00*** | (2006.01) |
| ***E04H 9/00*** | (2006.01) |
| ***E04B 2/00*** | (2006.01) |
| ***E04B 9/00*** | (2006.01) |
| ***E06B 3/54*** | (2006.01) |

(52) U.S. Cl. ..... 52/646; 52/424; 52/425; 52/415; 52/479; 52/649.1; 52/79.5

(58) Field of Classification Search ..... 52/424–428, 52/415, 431, 432, 434, 479, 442, 645, 646, 52/649.1, 580, 581, 80, 649.5, 562, 633, 52/378, 79.55; 446/478; 119/474
See application file for complete search history.

(56) References Cited

U.S. PATENT DOCUMENTS 1,102,991 A * 7/1914 McKennee ..... 52/428

(Continued)

FOREIGN PATENT DOCUMENTS

| | | | |
|---|---|---|---|
| DE | 20016264 | U | 12/2000 |
| FR | 2608196 | A | 6/1988 |
| NL | 8501343 | A | 12/1986 |

*Primary Examiner*—Robert J Canfield
*Assistant Examiner*—Ryan Franks
(74) *Attorney, Agent, or Firm*—Harness Dickey Pierce

(57) ABSTRACT

The aim of this invention is to increase the rigidity of the integrated formworks at the time of their installation, to facilitate the work of the civil engineers if order to determine easily the contribution of the horizontal frameworks and to reduce manufacturing costs. This aim is reached by a formwork including two parallel formwork walls placed one facing the other provided with shaped bars forming the vertical stiffeners and connected by at least one articulated connection device allowing the maintenance of the formwork walls either at a distance defining a space to receive a filler such as concrete, or folded for storage and transport. The connection device is characterized in that it includes a first rectilinear horizontal bar parallel to the first formwork wall and passing through the stiffeners of said first wall, a second rectilinear horizontal bar parallel to the second formwork wall and going through the stiffeners of said second wall, said second bar being situated facing the first bar, and a plurality of connection bars perpendicularly linking the two horizontal bars, said connection bars being articulated around said horizontal bars.

14 Claims, 7 Drawing Sheets

U.S. PATENT DOCUMENTS 1,111,131 A * 9/1914 Broughton ..... 52/270
1,836,398 A * 12/1931 Roberts ..... 52/250
2,042,438 A * 5/1936 Wells ..... 52/333
2,298,989 A * 10/1942 Underwood ..... 52/264
2,470,917 A * 5/1949 Aage ..... 52/427
2,969,619 A * 1/1961 Didrick ..... 52/601
3,204,382 A * 9/1965 McGurn ..... 52/349
3,474,576 A * 10/1969 Kieser ..... 52/108
3,971,180 A * 7/1976 Frederick ..... 52/251
4,136,495 A * 1/1979 Frederick ..... 52/251
4,454,702 A * 6/1984 Bonilla-Lugo et al. ... 52/745.13
4,864,792 A * 9/1989 Andre et al. ..... 52/426
4,970,841 A * 11/1990 Zeigler ..... 52/646
5,140,794 A * 8/1992 Miller ..... 52/309.12
5,323,578 A * 6/1994 Chagnon et al. ..... 52/426
5,398,470 A * 3/1995 Ritter et al. ..... 52/309.11
5,459,970 A * 10/1995 Kim ..... 52/424
5,487,248 A * 1/1996 Artzer ..... 52/309.12
5,528,876 A * 6/1996 Lu ..... 52/654.1
5,535,565 A * 7/1996 Majnaric et al. ..... 52/426
6,070,380 A * 6/2000 Meilleur ..... 52/309.7
6,167,671 B1 * 1/2001 Wilson ..... 52/654.1
6,226,942 B1 * 5/2001 Bonin ..... 52/309.12
6,231,024 B1 * 5/2001 Kugimiya et al. ..... 249/33
6,276,104 B1 * 8/2001 Long et al. ..... 52/309.4
6,282,853 B1 * 9/2001 Blaney et al. ..... 52/223.7
6,314,694 B1 * 11/2001 Cooper et al. ..... 52/309.12
6,314,697 B1 * 11/2001 Moore, Jr. ..... 52/426
6,321,498 B1 * 11/2001 Trovato ..... 52/426
6,336,301 B1 * 1/2002 Moore, Jr. ..... 52/426
6,363,683 B1 * 4/2002 Moore, Jr. ..... 52/741.13
6,438,918 B2 * 8/2002 Moore et al. ..... 52/426
6,481,178 B2 * 11/2002 Moore, Jr. ..... 52/741.13
6,526,713 B2 * 3/2003 Moore, Jr. ..... 52/309.11
6,609,340 B2 * 8/2003 Moore et al. ..... 52/309.11
6,625,947 B1 * 9/2003 Burgett ..... 52/424
6,665,992 B2 * 12/2003 Hew ..... 52/562
6,691,486 B1 * 2/2004 Durand ..... 52/645
6,701,683 B2 * 3/2004 Messenger et al. ..... 52/309.11
6,705,583 B2 * 3/2004 Daniels et al. ..... 249/34
6,898,908 B2 * 5/2005 Messenger et al. ..... 52/268
7,162,845 B2 * 1/2007 Messiqua ..... 52/404.1
7,320,201 B2 * 1/2008 Kitchen et al. ..... 52/426
7,337,591 B2 * 3/2008 Molina ..... 53/426
2004/0020149 A1 * 2/2004 Messiqua ..... 52/426
2004/0040251 A1 * 3/2004 Mok ..... 52/719
2008/0104911 A1 * 5/2008 Jarvie et al. ..... 52/309.1

* cited by examiner

HIGH-STRENGTH CONCRETE WALL FORMWORK

FIELD OF THE INVENTION

This invention has for an object a formwork for the manufacture of a concrete or concrete-like material wall. This formwork is constituted of two metallic formwork walls provided with vertical stiffeners and placed one facing the other. These formwork walls are linked by a connection device separating the walls by creating a space between them to be filled with material such as concrete.

TECHNICAL BACKGROUND

In order to guarantee the solidity of buildings' walls or of other concrete works, it is foreseen to have at its disposal an additional vertical framework inside the walls. A common technique consists in using this formwork system as a permanent or integrated formwork, that is to say, with a formwork which subsists as an integral part of the wall after having poured concrete on the inside.

The documents EP0883719 and WO02/38878 describe a formwork comprising an outer wall and a backing wall, these walls, called formwork walls, include vertical stiffeners made up of section bars, generally U-shaped. The formwork walls are linked by connection devices, each of them made up of a slightly zigzagging bent bar which is articulated at the level of the stiffeners. Between the formwork walls, these devices maintain a determined space into which the concrete is poured.

WO03/010397 describes the formwork of the above-mentioned documents where framework elements are introduced between the lateral sides of the U-shaped sections of two stiffeners placed opposite each other on each wall. Each framework element includes at least one vertical bar and at least two horizontal bars adjusted to slide into the stiffeners section. This framework element is added after opening out the formwork walls by sliding in the stiffeners, which act as guide rails. The U-shaped form of these stiffeners ensures the maintenance and the stability of this framework element and also facilitates its insertion.

The different elements of the formwork such as the formwork walls, the connection devices and the stiffeners are factory pre-fabricated, then assembled with the aid of appropriate fasteners to form the formwork. Formwork produced in this way leaves the factory in a folded form thanks to articulations of connections elements on the stiffeners, then it is opened out on the building site at the time of its installation to compose a wall.

SUMMARY OF THE INVENTION

The formworks of the above-mentioned prior art present an excellent resistance to high stresses in particular due to high intensity earthquake shocks. However, contrary to the rectilinear frameworks usually used, the zigzag form of the connection elements between the walls makes it difficult for the civil engineers to quantify with precision how much they contribute to wall resistance. The aim of this invention is to increase the rigidity of the integrated formworks at the time of their installation, to facilitate the work of the civil engineers in order to determine easily the contribution of the horizontal frameworks and to reduce manufacturing costs.

This aim is reached by a formwork for concrete wall including two parallel formwork walls placed one facing the other provided with shaped bars forming vertical stiffeners and connected by at least one articulated connection device allowing the maintenance of the formwork walls, either by a distance defining a space to receive a filler such as concrete, or folded for storage and transport, characterized in that the connection device includes a first rectilinear horizontal bar parallel to the first formwork wall and passing through the stiffeners of said first wall, a second rectilinear horizontal bar parallel to the second formwork wall and going through the stiffeners of said second wall, said second bar being situated facing the first bar, and a plurality of connection bars perpendicularly linking the two horizontal bars, said connection bars being articulated around said horizontal bars.

The notions of vertical and of horizontal are relative because the whole formwork can be turned on the basis of a 90° angle. Thus, the originally vertical elements become horizontal and vice versa. In practice, at the time of the construction of a wall the formwork is set up on a surface more or less horizontal (ground or slab floor) in such a way that the stiffeners are arranged in the vertical direction. According to a preferred embodiment, the stiffeners are made up of U-shaped section bars whose aperture is directed in towards the formwork. These stiffeners, fixed on the formwork walls at approximately regular intervals, are pierced with lateral holes having a diameter sufficient to ensure the free passage of a rectilinear horizontal bar. The connection bars are disposed, preferably, between the lateral sides of the U formed by the stiffeners in order to limit their displacement along horizontal bars and to maintain between them a constant interval corresponding to the one existing between the stiffeners.

The horizontal bars are also distributed at approximately regular intervals on the height of the formwork walls. This configuration allows the disposition of connection bars at regular intervals in the height direction as well as in the length direction of the formwork. This positioning ensures a uniform space between the formwork walls when the concrete is poured. The articulations of the connections bars around the horizontal bars allow the formwork walls to be folded one on the other during storage and transport from the factory towards the building site.

The main advantage of the connection device according to the invention in comparison with the zigzag device of the prior art lies in that it allows a more important use of section bars. In fact, given that that the horizontal bars, which are parallel to the formwork walls, are rectilinear, it becomes possible to increase their diameter without any important drawbacks connected with manufacture, unlike the connection device formed by a zigzag bar. In this case, the more the section of a bar becomes important, the more the means used for folding and setting the bar become consequent and reach a high cost. So, by suppressing the folding operations of the connection device bars, a contribution is given for the decrease of the manufacturing costs.

Setting the bars of the connection device according to the invention is also easier since they are positioned by sliding across holes previously pierced into the stiffeners at a suitable diameter. The section of the connection bars can also be increased in proportion to the section of the horizontal bars.

Therefore, thanks to the possibilities of using bars with a larger section, the connection device becomes more rigid which allows the easier setting of the formwork on the site, the optimum alignment and consequently the possibility to reduce the thickness of the coating layer. The coating layer consists in a mortar coating applied on the external faces of the formwork walls after having poured the concrete into the formwork. Thanks to the great rigidity, improved flatness of the formwork walls can be obtained, allowing the distribution of a coating having regular thickness on each surface of the latter, without any need to compensate for deformations.

Another advantage of the formwork structure according to the invention is that the easier introduction of a floating framework is allowed between the two formwork walls and in the intervals separating the connection bars. This framework, composed of at least two vertical bars linked by cross bars, slides into the intervals by the upper part of the formwork when this one is set at the location of the wall to be built before pouring the concrete. According to an alternative, the framework can be hooked onto the upper part of the formwork in order to maintain its own position at the time of the filling of the formwork with concrete.

Furthermore, filling tests have shown that the formwork according to the invention allows the reduction of concrete segregation risks. The concrete fall is slowed down by the presence of obstacles, which act as filter and reduce segregation risks.

The obstacles placed in the concrete flow between the two formwork walls are of the same order in the structure according to the invention as in the invention where a zigzag connection device is used. In both cases, the elements of the connection device, which pass through the space between the walls, form many obstacles to the concrete flow.

BRIEF DESCRIPTION OF THE DRAWINGS

The invention will be better understood thanks to the detailed following description with reference to the enclosed drawings, which are given as a non-limitative example, namely.

DETAILED DESCRIPTION OF THE INVENTION

Figure 1:
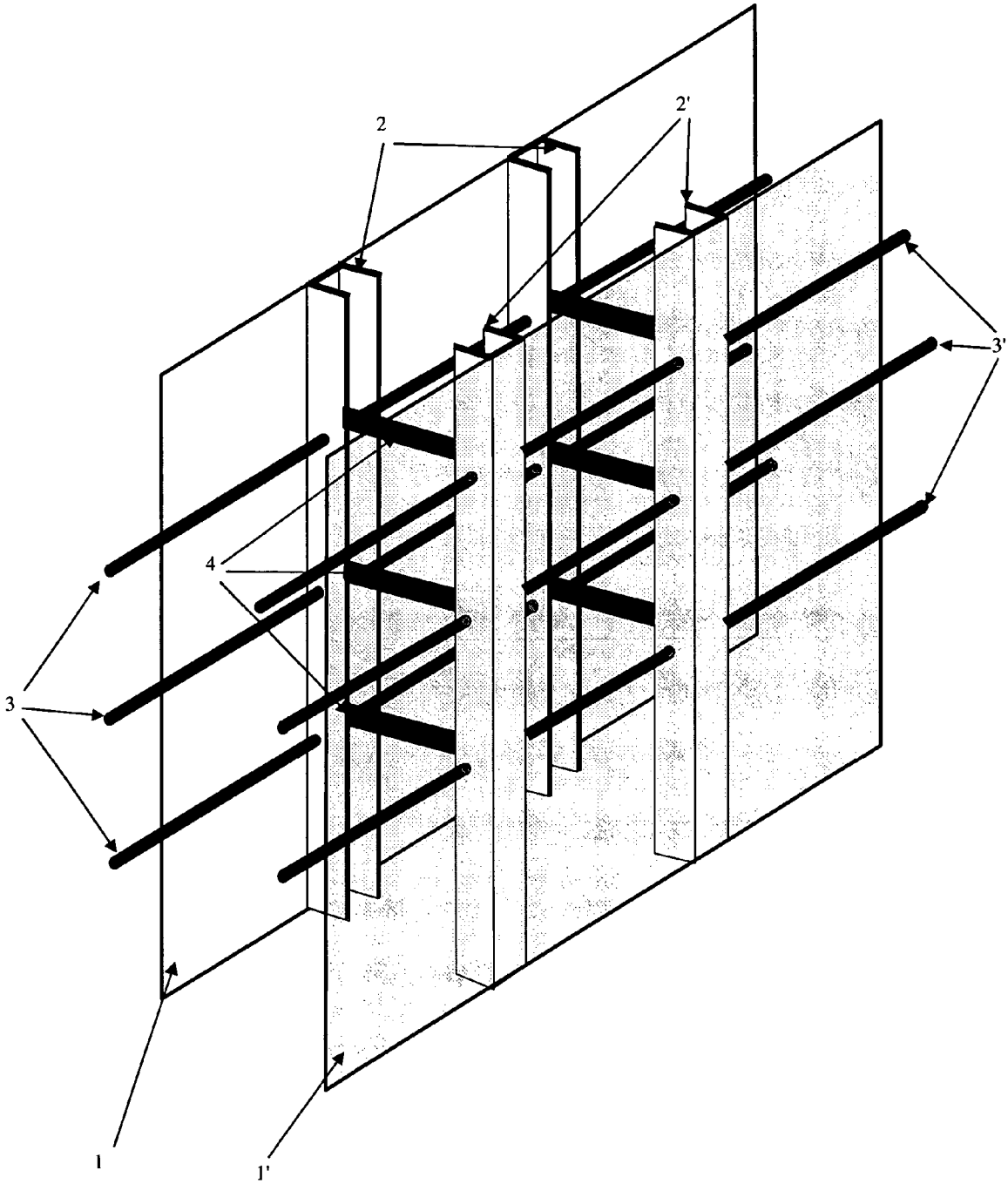
FIG. 1 shows a view in perspective of the formwork according to the invention.

FIG. 1 shows a part of a formwork for a concrete wall including two parallel formwork walls placed one facing the other. Each wall is provided with U-shaped vertical bars whose aperture is directed in towards the formwork. They are spaced preferably at regular intervals on the entire length of the wall. These bars called stiffeners contribute to the stability of the formwork walls (1, 1'), which are generally made up of relatively flexible latticed metallic panels. The stiffeners are fixed to the mesh of the formwork walls by welding, by hooking on the lugs or by tying with metallic wire means.

The formwork walls include horizontal ribs distributed at more or less regular intervals on the height. These ribs are used to stiffen the walls in order to avoid their deformation under the push of the concrete, above all in the case where the intervals between the vertical stiffeners are large.

The mesh of the formwork walls has a size adapted to the passage of the finest particles of the filler concrete. This fine concrete coming out of the formwork is used for the final coating of the wall since it facilitates the application of a coating mortar (outside) or of plaster (inside the building).

The formwork walls are maintained parallel to a determined distance thanks to connection devices distributed on the entire wall height. Each device is made up of a couple of parallel rectilinear horizontal bars placed one facing the other and linked by a plurality of connection perpendicular bars (4) whose lengths are approximately equal to the distance separating the formwork walls (1, 1'). The horizontal bars are firmly attached to the formwork walls to which they are maintained by the stiffeners (2, 2'). These stiffeners are perforated in the lateral sides of the U section having a larger diameter than that of the horizontal bar (3, 3'). These holes are positioned one facing the other on each lateral side and facing the holes of the lateral sides of the near stiffeners in such a way that the free sliding of the horizontal bar is allowed when it passes through each stiffener of the formwork wall (1, 1'). The connection bars (4) are perforated at each end allowing the free movement of the horizontal bar (3, 3'). This connection bars' fastening (4) allows them to be articulated around the horizontal bars and thus the formwork walls can be folded one against the other at the time of storage or transport. These connection bars (4) are preferably positioned between the lateral sides of the U formed by the stiffeners in order to prevent them from moving along the horizontal bars either during the setting of the formwork or during the pouring of the concrete.

Figure 2:
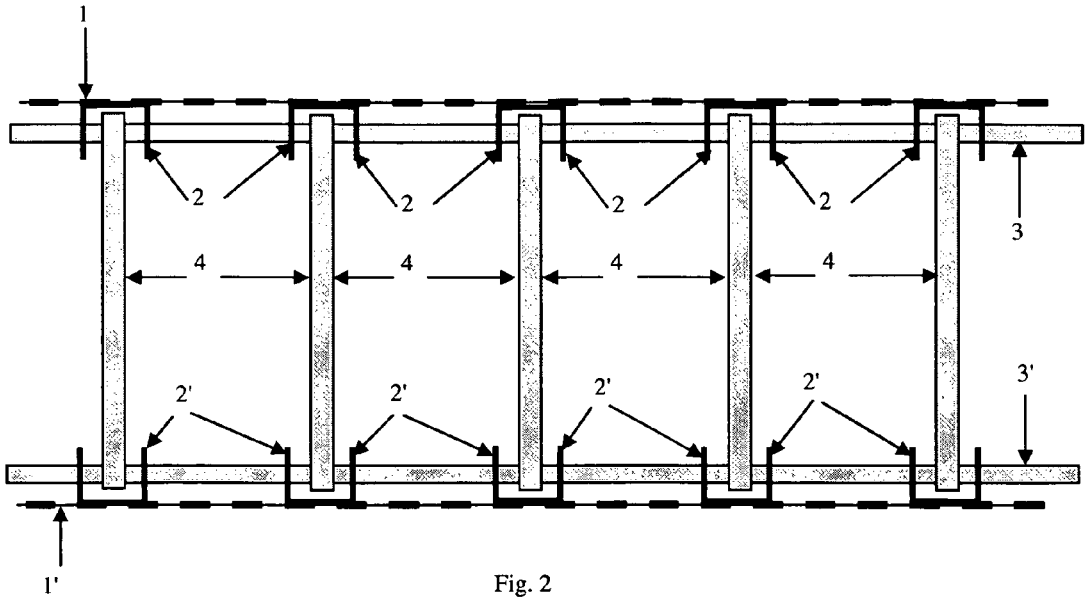
FIG. 2 shows an overview of the formwork of FIG. 1.

According to a first alternative represented by FIG. 2, which is an overview of the formwork of FIG. 1, the stiffeners of the formwork walls facing each other are placed opposite each other. The connections bars (4) are placed between the U lateral sides of two opposed stiffeners and are articulated around the horizontal bar part being between these sides.

Figure 3:
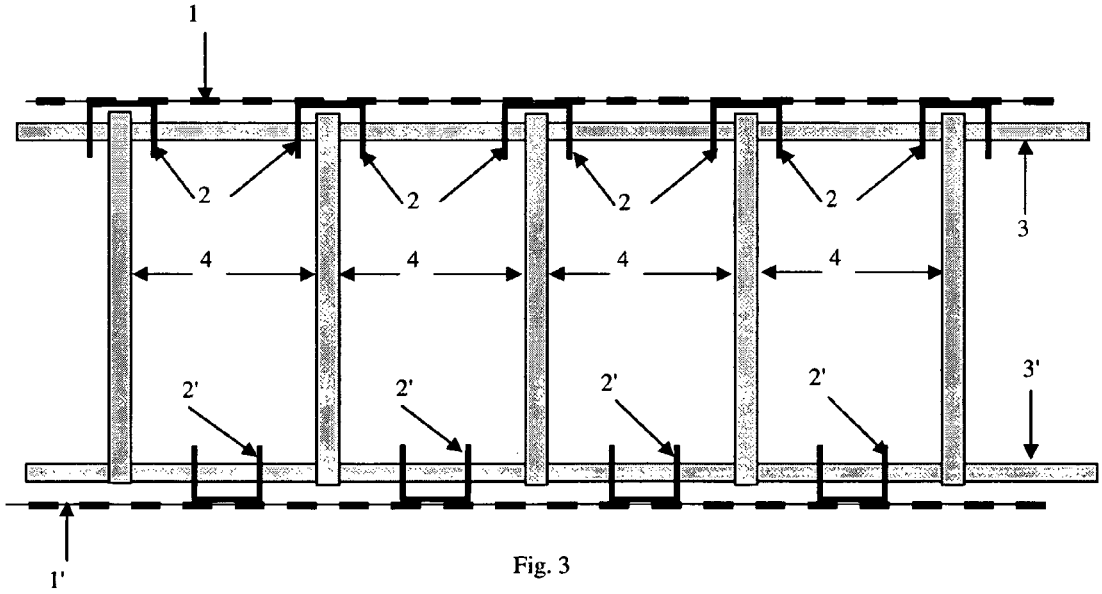
FIG. 3 shows an overview of a formwork alternative where the stiffeners are placed in staggered rows.
Figure 2A:
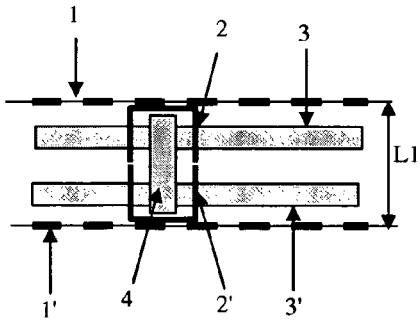
FIG. 2*a* shows a part of the formwork of FIG. 2 when this is folded.
Figure 3A:
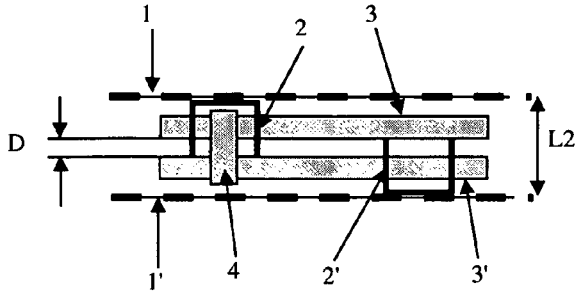
FIG. 3*a* shows a part of the formwork of FIG. 3 when this is folded.

According to a second alternative represented by FIG. 3, the stiffeners of a formwork wall are out of line in comparison with the stiffeners of the facing wall. In this configuration, only one of the ends of a connection bar (4) is articulated between the U lateral sides of a stiffener while the other end is articulated around a part of the opposed horizontal bar situated between two stiffeners (4). This alternative allows the reduction of the L1 width of the formwork when it is folded. In fact, as the formwork is folded, two opposed stiffeners stand one next to the other on the horizontal bars (FIG. 3*a*) instead of superposing one over the other as in the first alternative, see FIG. 2*a*. The width difference (L1–L2) of the folded formwork is equivalent to the D distance separating a horizontal bar of the edge of the lateral sides of a stiffener as shown in FIG. 3*a*. This D distance depends on the stiffeners' size (2, 2'), on the section of the horizontal bars as well as on the positioned of the hole for these bars to pass through, in the lateral sides of the stiffeners (2, 2'). This gain in width can be advantageous for the storage or the transport of an important quantity of stacked formworks by reducing their bulk.

Figure 4:
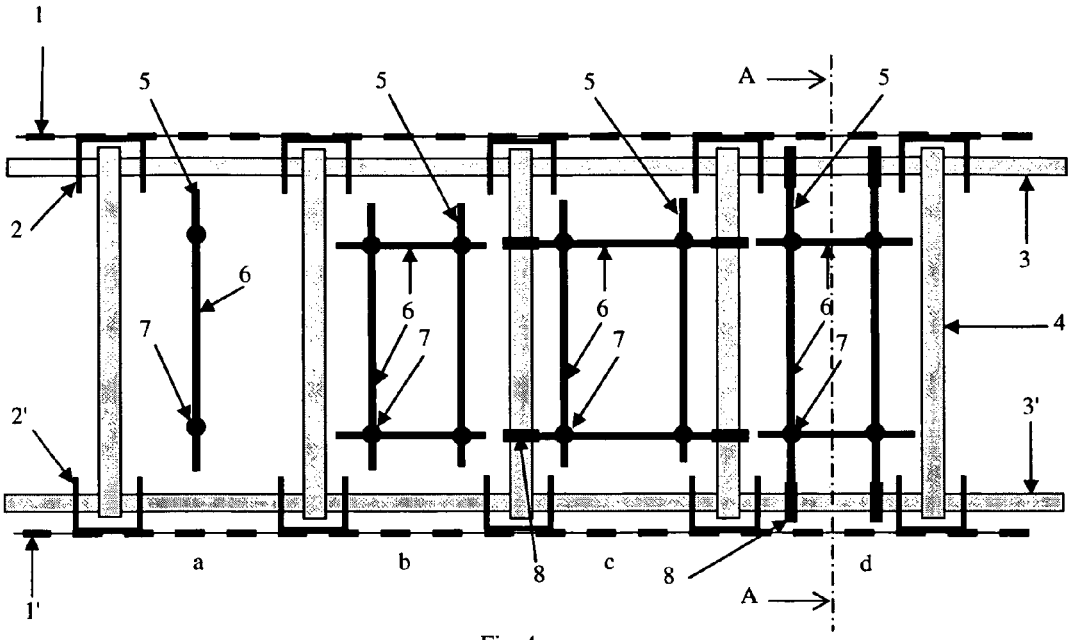
FIG. 4 shows several alternative frameworks introduced into the formwork intervals.

FIG. 4 shows several possibilities (a, b, c, d) of metallic frameworks (5) which stand from the top interior of the formwork in the spaces, which are delimited by the connection bars (4) and the formwork walls (1, 1'). These frameworks (5) are installed on the building site when the opened out formwork is positioned in the location of the wall to be constructed before the concrete pouring operation between the formwork walls (1, 1'). They are intended to be completely embedded in the concrete and are used to reinforce the wall.

The continuous spaces from the top to the bottom of the formwork allow the easy introduction of different frameworks types (5) having the a height approximately equal to that of the formwork. The examples illustrated on FIG. 4 are not exhaustive, other frameworks structures (5) including a variable vertical (7) and/or horizontal (6) bars number set in different ways are also possible as long as their size is adapted to the spaces between the formwork walls (1, 1').

The alternative (a) of the framework (5) of FIG. 4 includes two vertical bars (7) linked by a plurality of horizontal bars (6). This floating type framework (5) is set in a central zone of the space between the formwork walls (1, 1'). This framework is temporarily maintained by a hooking device at the time of the pouring of the concrete in order to avoid movement. The alternative (b) including four vertical bars (7) linked by horizontal bars (6) offers better stability.

Contrarily to the previous alternatives, the alternatives (c) and (d) can be distinguished by the presence of a fastening device in the form of hooks (8) which allows them to be maintained in place at the time of the pouring of the concrete without using a temporary hooking device. The hooking is carried out on the upper and accessible part of the formwork either on the connections bars (4) (alternative c), or on the horizontal bars (alternative d) of the last connection device. The hooks (8) can be replaced by a fastener or by wire tying.

Figure 5:
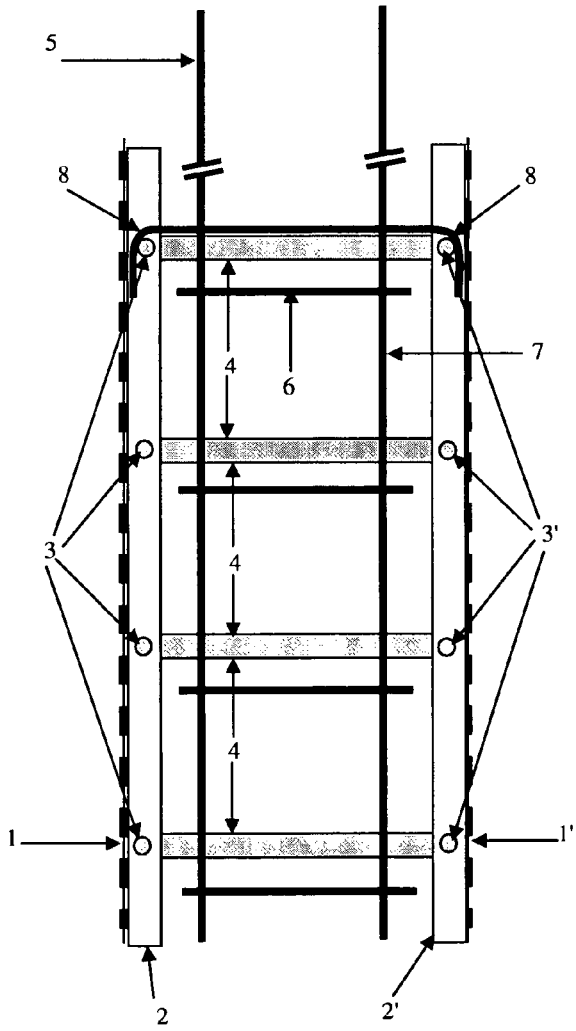
FIG. 5 shows a cross section of the formwork of FIG. 4 showing one of the alternatives of the framework.

FIG. 5 shows a cross section according to the A-A axis of the formwork of FIG. 4, which shows the alternative (d) of the framework (5) hooked to the highest horizontal bars and which continues on the whole formwork height.

Figure 6:
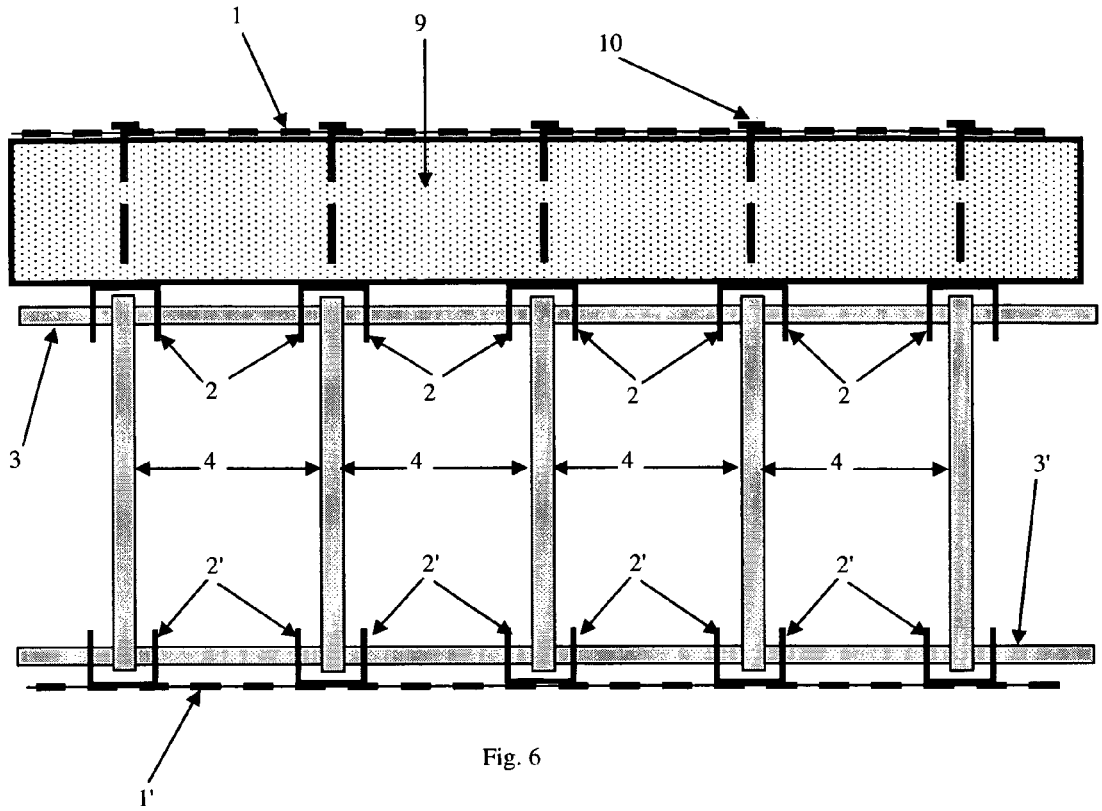
FIG. 6 shows an overview of a formwork's alternative including an insulating wall.

FIG. 6 shows another alternative of the formwork, which comprises an insulating panel (9), for example in expanded polystyrene, between one of the formwork walls and the corresponding stiffeners (2, 2'). When the wall is finished, by using this type of formwork no more insulating panels are necessary. This also contributes to the reduction of construction costs.

This insulating panel (9), extending on the whole surface of the formwork wall (1, 1'), is fixed to the back of the stiffeners by means of screws or of fasteners (10) which, passing through the panel (9), maintain the formwork wall against the stiffeners (2, 2'). The formwork wall (1, 1'), thus being on the external face of the insulating panel (9), is coated with fine concrete after the space between the insulating panel (9) and the second formwork wall has been filled. Frameworks (5) can be inserted into the space between the connection bars (4) in the same way as in the configuration of the formwork without any insulating panel as shown in FIGS. 4 and 5.

Figure 7A:
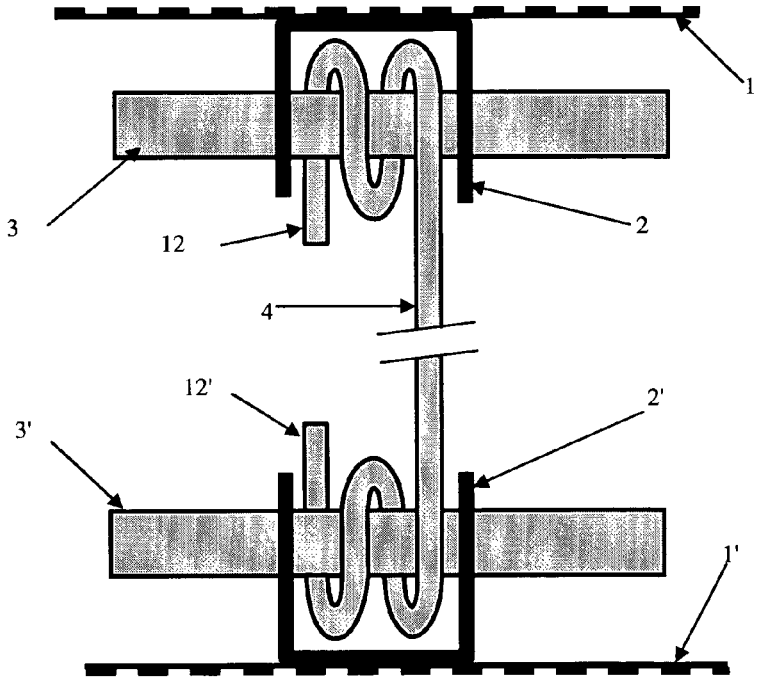
FIG. 7*a* shows a different implementation of the connection bars with ends rolling-up around horizontal bars, the stiffeners of a formwork wall are facing those of the other wall.

FIG. 7*a* shows an example of the implementation of a connection bar (4) made up of a steel bar, for example, whose ends (12, 12') are curved in such a way that they can roll-up around horizontal bars (3, 3'). This implementation, being an alternative to the bars (4) which are perforated at each end for the horizontal bars to pass through and which constitute the articulation around the latter, can of course be applied to the examples of formworks described above and illustrated in FIGS. 1 to 6. In order to avoid the connection bar moving (4) along the horizontal bars, at least one of its ends (12, 12') is rolled-up around the horizontal bar part being between the lateral sides of the U formed by the stiffeners of one or the other of the formwork walls (1, 1'). In the frameworks for formwork domain, the curvatures of the steel bars or bending are preferable to drilling. In fact, a bar whose ends are formed as in FIGS. 7*a* and 7*b* will have a higher and directly proportional resistance to its section than a similar perforated bar.

Figure 7B:
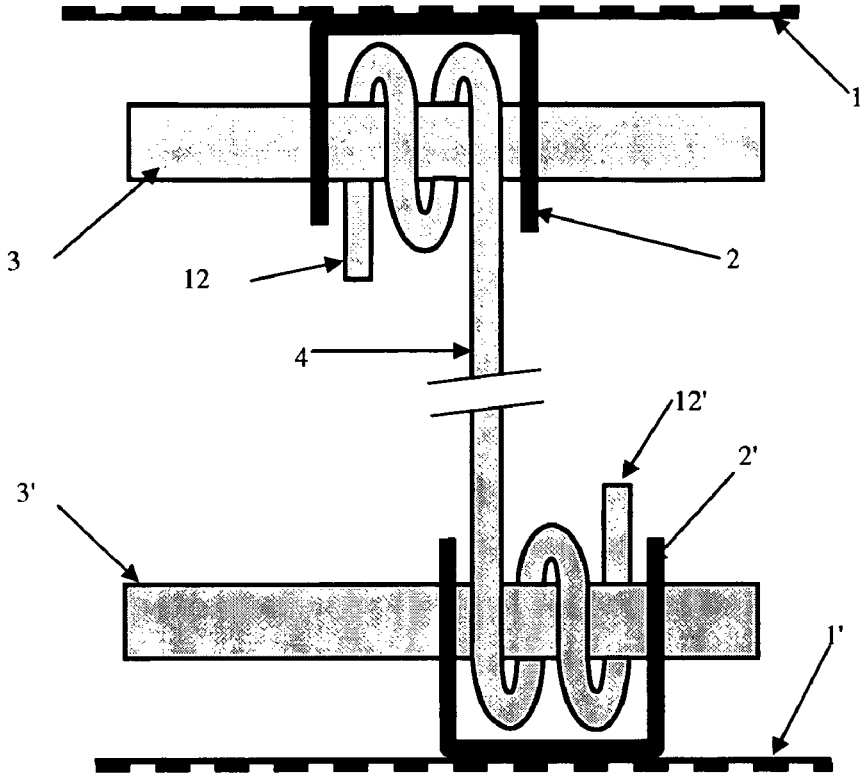
FIG. 7*b* shows the alternative of the connection bars of FIG. 7*a* with the stiffeners in staggered rows.

The preferred configuration represented by FIG. 7*b* can be distinguished by the fact that the stiffeners of a formwork wall are placed in staggered rows with respect to those of the facing wall in a way that allows the perpendicular positioning of the connection bars (4) to horizontal bars with each of their ends (12, 12') in the corresponding stiffeners section (2, 2'). The advantage of this disposition is its capacity to reduce the formwork width, when folded, in a way similar to the alternative shown by FIGS. 3 and 3*a*, as well as to ensure a good stability of the formwork when it is opened out on the building site.

Figure 8A:
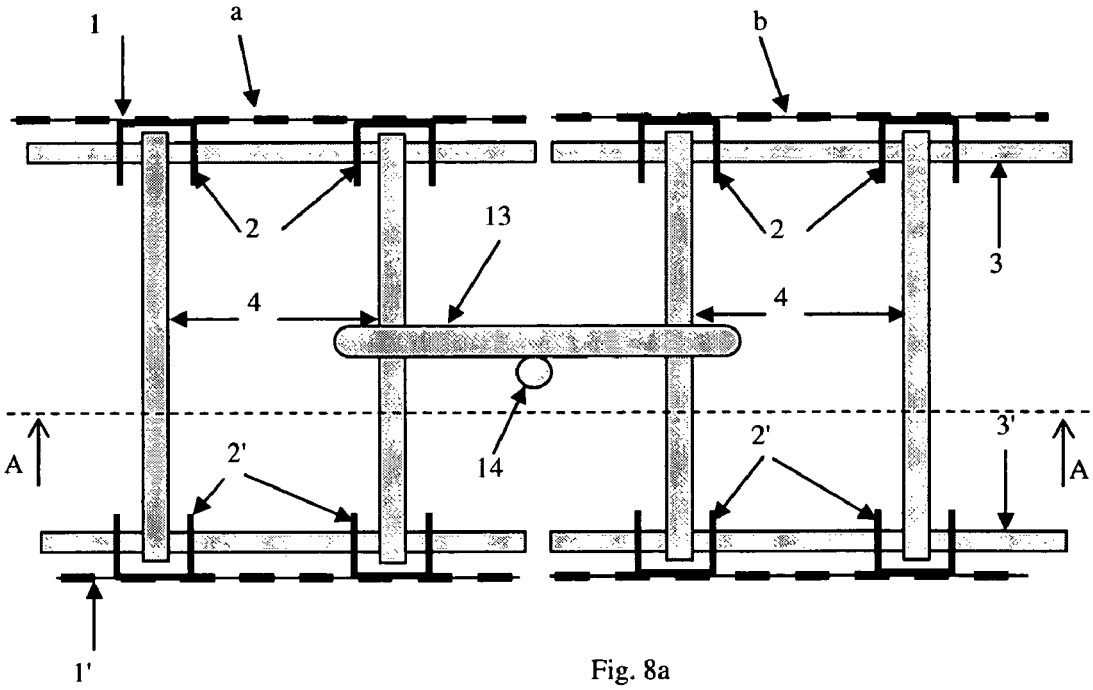
FIG. 8*a* shows an overview of a first connection alternative between two formwork panels using a vertical bar with U-shaped bars.
Figure 8B:
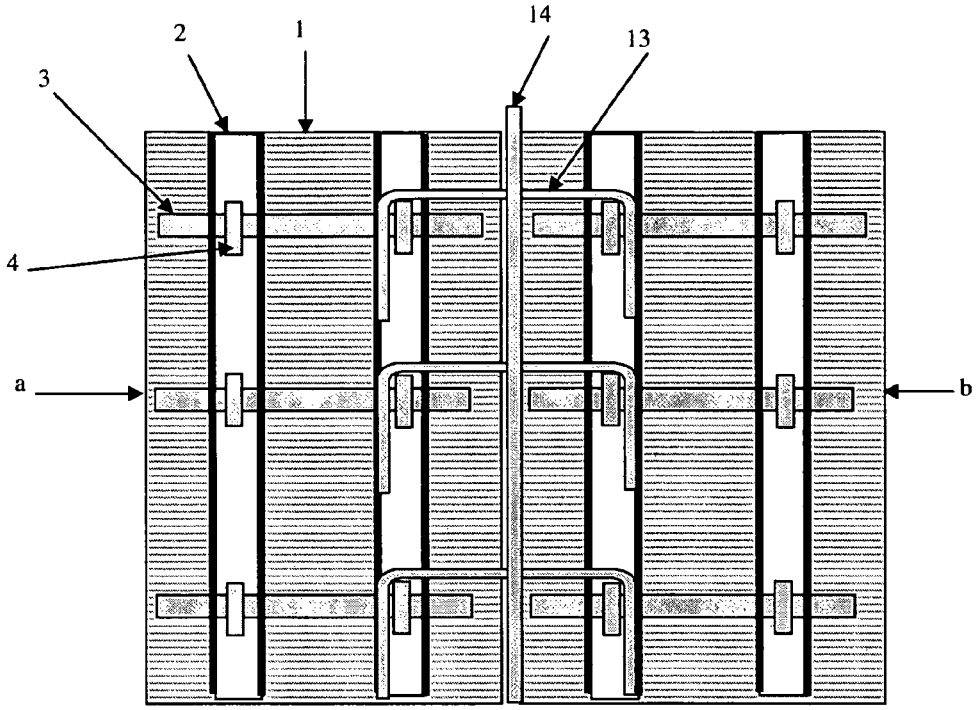
FIG. 8*b* shows the alternative of FIG. 8*a* viewed according to a section between the formwork walls.

A concrete wall is in general built with a formwork made up of several formwork panels linked one to the other. The FIGS. 8*a* (view from the formwork top) and 8*b* (section between the formwork walls according to the A-A axis) show a first alternative connection between two formwork panels a and b. The continuity of the horizontal bars between two contiguous panels (a, b) is ensured by the setting on the site, to the junction of the panels (a, b), of a set made up of a vertical bar (14) on which reversed-U-shaped bars (13) are welded and placed at the same distance as the horizontal bars of the panels (a, b). This set (13, 14) is introduced from the top at the level of the junction of the panels (a, b), then swiveled round on itself at 90° so that the U-shaped bars (13) are supported by the last connection bars (4) at the junction of each panel (a, b) while maintaining them firmly attached to each other.

Figure 9A:
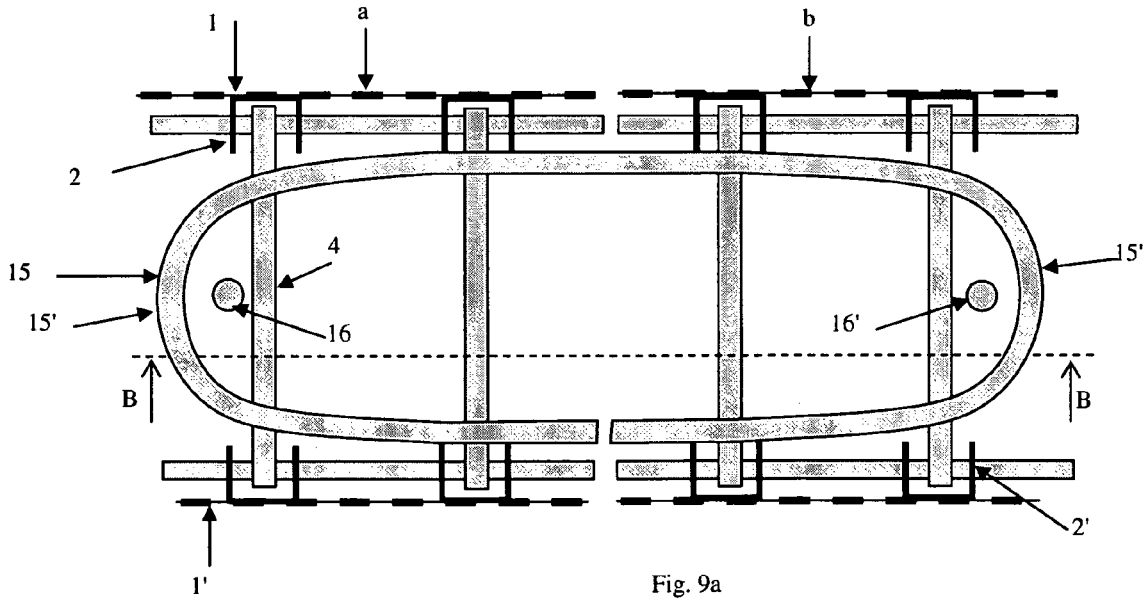
FIG. 9*a* shows an overview of a second connection alternative between two formwork panels using looped flexible bars and two vertical framework bars.
Figure 9B:
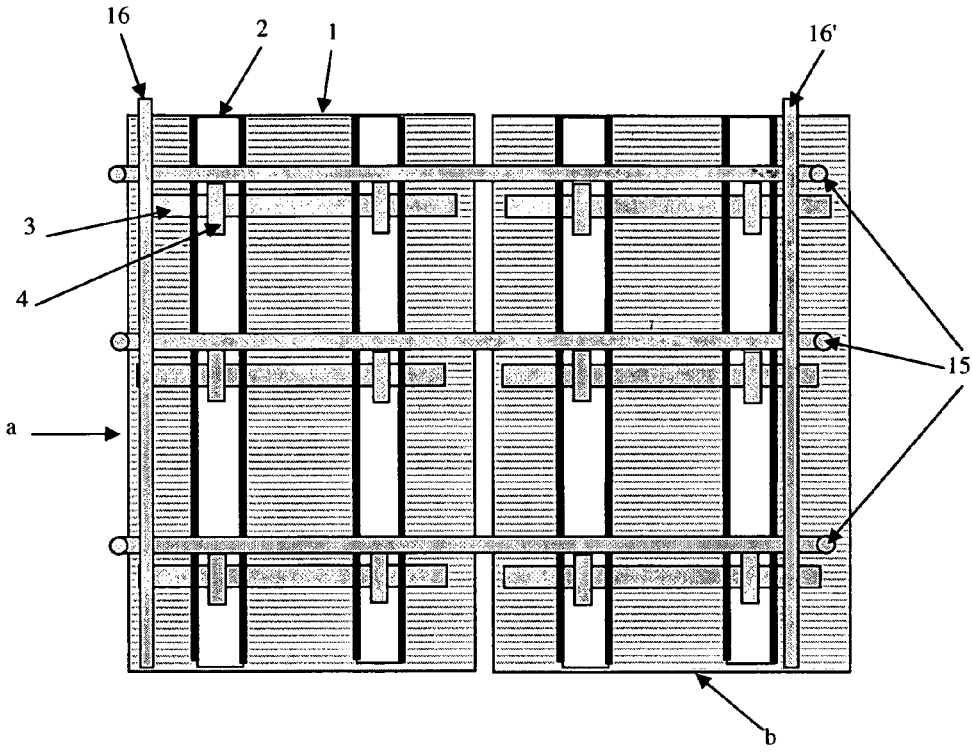
FIG. 9*b* shows the alternative of FIG. 9*a* viewed according to a section between the formwork walls.

The FIGS. 9*a* (view from the formwork top) and 9*b* (section between the formwork walls according to the B-B axis) show a second connection alternative between contiguous panels (a, b). It consists in using loop flexible steel bars (15) which penetrate between the formwork walls at the level of the horizontal bars and set on the last connection bars (4) towards the junction of the panels (a, b). In order to maintain these looped bars (15) in place, a vertical framework bar (16, 16') is introduced from the top in the space between a connection bar (4) next to the junction and the curve (15') of the loop formed by the bar (15) on both panels (a, b). These framework bars (16, 16') pass through the curve (15') of the loop (15) at the level of each connection bar (4) situated one above the other near the junction of the two formwork panels (a, b) as shown in FIG. 9*b*.

The looped bars (15) are preferably mounted on the building site after a first formwork panel (a) has been opened out, inserting them between the formwork walls on one of the vertical sides at the level of the connection bars (4) in such a way that they protrude out of the panel (a). A second panel (B) is then opened out and set in the prolongation of the first one, introducing the parts of the looped bars (15), which protrude out of the first panel (a) between the formwork walls of the second panel at the level of the connection bars (4). The vertical framework bars (16, 16') are set from the top of the panels (a, b) to conclude the connection operation of the two panels (a, b).

Figure 10:
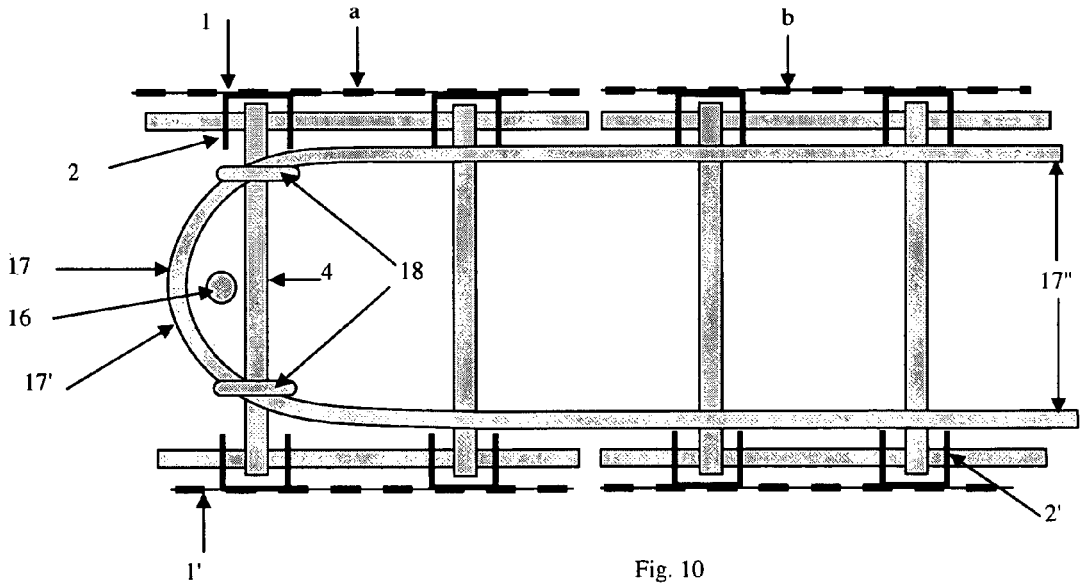
FIG. 10 shows a top view of a third connection alternative between two formwork panels using the flexible U-folded bars and a vertical framework bar.

FIG. 10 shows a third connection alternative between two formwork panels a and b where they are linked by flexible steel U-shaped folded bars (17). The curved part (17') of the U penetrates between the two formwork walls of the first panel (a) at the level of the connection bars (4) and the sticks of the U (17") penetrate between the formwork walls of the second panel (b).

These U-shaped bars (17) are preferably introduced, in the factory, between the formwork walls on a vertical side of the panels and stiffened, by means of wire for example (18), to the connection bars (4) in such a way to be maintained when the panel is folded for storage and transport. Generally, the stiffeners (18) are not carried out on the last connection bars (4) of the panel, but preferably on the internal connection bars next to the last ones for junction stability reasons.

At the building site, a first panel (a) is opened out and the U-shaped bars (17) are supported by the connection bars (4), the sticks of the U (17") are released in such a way that they protrude out of the vertical side of the panel (a). The second panel (b) is positioned in the prolongation of the second in such a way that the sticks of the U (17") which protrude out of the first panel (a) penetrate between the formwork walls of this second panel (b). These sticks (17") are placed on the last connection bars (4) next to the vertical side of the second panel (b). As in the previous alternative, a vertical framework bar (16) is introduced from the top of the first panel (a) in the space between the curved part of the U (17') of the flexible bars (17) and the connection bars (4).

The invention claimed is:

1. A formwork for a concrete wall, the formwork comprising:

two parallel formwork walls made of metallic latticed panels placed facing each other provided with metallic shaped bar forming vertical stiffeners and connected by at least one articulated metallic connection device allowing the formwork walls to be maintained either at a distance defining a space to receive a filler such as concrete, or folded for storage and transport, wherein, the at least one articulated metallic connection device includes:

a first rectilinear horizontal metallic bar parallel to the first formwork wall and pass through holes in the stiffeners of said first wall, a second rectilinear horizontal metallic bar parallel to the second formwork wall and passing through holes in the stiffeners of said second wall, said second bar being situated facing the first metallic bar, and a plurality of metallic connection bars linking perpendicularly the two horizontal bars, said connection bars being articulated around said horizontal bars.

2. The formwork according to claim 1, wherein the stiffeners of the formwork walls facing each other are generally U-shaped and are placed opposite each other and the connections bars are placed between the lateral sides of the U-shaped sections of two stiffeners which are opposed and articulated around the horizontal bar part situated between these sides.

3. The formwork according to claim 1, wherein the stiffeners of the formwork walls are generally U-shaped and the stiffeners of a formwork wall are out of line in comparison with those of the other formwork wall, and one of the ends of a connection bar is articulated between the lateral sides of the U-shaped section of a stiffener while the other end is articulated around a part of the opposed horizontal bar situated between two stiffeners.

4. The formwork according to claim 1, wherein the stiffeners of the formwork walls are spaced at approximately regular intervals on the length of the formwork walls.

5. The formwork according to claim 1, wherein the horizontal bars are spaced at approximately regular intervals on the height of the formwork walls.

6. The formwork according to claim 2, wherein each lateral side of the U-shaped section of the stiffeners includes holes positioned one facing the other on each lateral side and facing those of the lateral sides of the near stiffeners in such a way that they allow a horizontal bar to slide freely when it goes through each stiffener of the formwork wall.

7. The formwork according to claim 1, wherein the connection bars include a hole at each end by which the horizontal bar passes freely by carrying out the articulation of said connection bar around said horizontal bar.

8. The formwork according to claim 1, wherein the connection bars include curved ends which roll-up around the horizontal bars.

9. The formwork according to claim 8, wherein the stiffeners are generally U-shaped with lateral sides and at least one of the ends of the connection bars is rolled-up around the horizontal bar part which is between the lateral sides of the U formed by the stiffeners of one of the formwork walls.

10. The formwork according to claim 1, wherein the connection bars are positioned at approximately regular intervals in the length direction as well as in the height direction of the formwork walls.

11. The formwork according to claim 1, including a framework disposed in the spaces delimited by the connection bars and by the formwork walls, said framework includes at least two vertical bars having the height approximately equal to the height of the formwork and a plurality of horizontal bars linking the two vertical bars.

12. The formwork according to claim 11, wherein the frameworks, which is of floating type, is situated in a central zone of the space that it occupies between the formwork walls and the connection bars.

13. The formwork according to claim 11, wherein the framework is maintained, by hooks or fasteners either on the horizontal bars, or on the uppermost connection bars of the formwork.

14. The formwork according to claim 1 further comprising:

an insulating panel situated between the stiffeners and one of the formwork walls, said insulating panel, extending on the whole surface of the formwork wall, is fixed at the back of the stiffeners by means of screws or fasteners which, going through the panel, maintain the formwork wall against the stiffeners.

* * * * *